United States Patent [19]

Kuhn

[11] Patent Number: 4,642,651

[45] Date of Patent: Feb. 10, 1987

[54] DUAL LENS ANTENNA WITH MECHANICAL AND ELECTRICAL BEAM SCANNING

[75] Inventor: Donald H. Kuhn, North Syracuse, N.Y.

[73] Assignee: The United States of America as represented by the Secretary of the Army, Washington, D.C.

[21] Appl. No.: 653,645

[22] Filed: Sep. 24, 1984

[51] Int. Cl.[4] ..... H01Q 3/02; H01Q 19/06

[52] U.S. Cl. ..... 343/754; 343/757; 342/376

[58] Field of Search ..... 343/753–755, 343/757, 762, 909, 911 R, 368, 371, 372, 376

[56] References Cited

U.S. PATENT DOCUMENTS 2,975,419 3/1961 Brown ..... 343/754

3,305,867 2/1967 Miccioli et al. ..... 343/754

3,953,857 4/1976 Jenks ..... 343/705

4,415,901 11/1983 Gans ..... 343/754

FOREIGN PATENT DOCUMENTS 53-27347 3/1978 Japan ..... 343/753

53-35458 4/1978 Japan ..... 343/754

*Primary Examiner*—Eli Lieberman

*Assistant Examiner*—Michael C. Wimer

*Attorney, Agent, or Firm*—Freddie M. Bush; Robert C. Sims

[57] ABSTRACT

A mechanically positioned phase steered transfer lens which is illuminated by a fixed collimation lens. Wide angle scan is accomplished by tilting the movable lens and electronically scanning the beam to the desired angle. The mechanical motion minimizes the required electronic scan angles, thus minimizing the number of phase shifters required.

1 Claim, 3 Drawing Figures

DUAL LENS ANTENNA WITH MECHANICAL AND ELECTRICAL BEAM SCANNING

DEDICATORY CLAUSE

The invention described herein was made in the course of or under a contract or subcontract thereunder with the Government and may be manufactured, used, and licensed by or for the Government for governmental purposes without the payment to me of any royalties thereon.

DESCRIPTION OF THE BEST MODE AND PREFERRED EMBODIMENT

Figure 1:
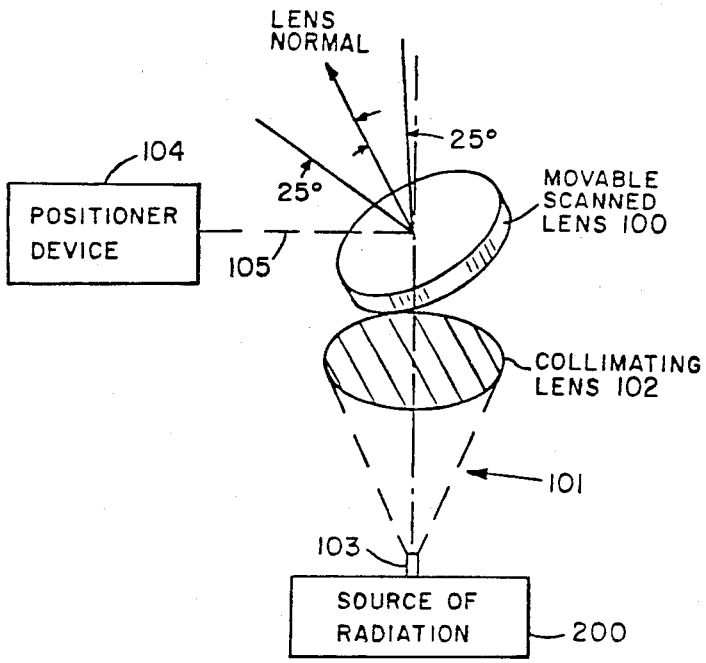
FIG. 1 is a diagrammatic showing of the combined mechanical-electronic scan antenna.
Figure 2:
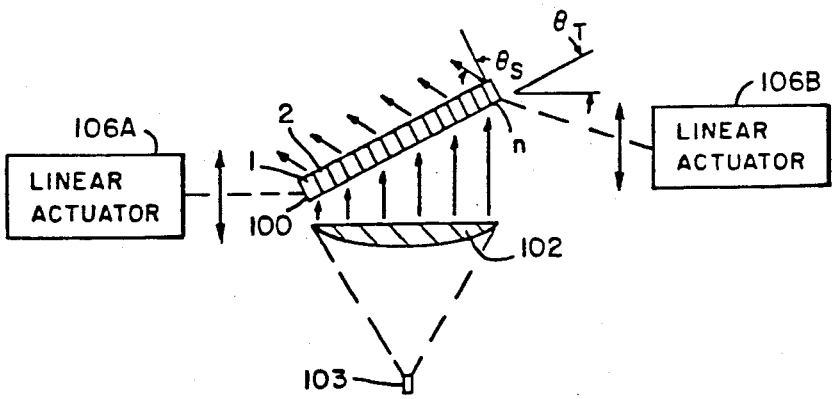
FIG. 2 is a diagrammatic showing of a cross section of the present invention.
Figure 3:
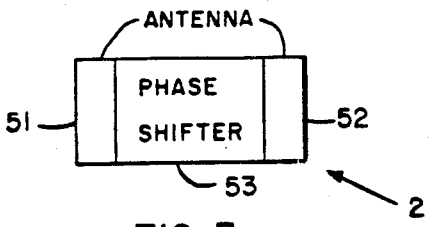
FIG. 3 is a block diagram of a phase shifter module.

The antenna cncept is shown in FIGS. 1, 2 and 3. The antenna consists of an active lens 100 which is positionable above a collimation and feed assembly 101 to receive radiation from a source 200. The active lens 100 is an array of phase shifter modules 1-n, with radiating elements (antennas) on both ends of each phase shifter. FIG. 3 shows a typical module 2 which has two antenna 51 and 52 sandwiching a phase shifter 53. During transmission, this array receives energy from the feed and collimation lens 102 by means of the elements on the feed side of the lens. These signals are phase shifted in passing through the movable, scanned lens 100 and reradiated out the opposite face in a new direction, depending upon the phase shift introduced by the array of phase shifters 1-n.

The collimation lens 102 is a fixed lens, which converts the spherial wave from the feedhorn assembly to a plane wave. The active lens 100 can take the form of any of the well known antennas such as those shown in U.S. Pat. Nos. 3,305,867; 3,406,399; and 3,484,784.

Radiation from a monopulse feedhorn 103 is converted into collimated plane waves directed vertically in the figures. These are received by the movable, scanned lens 100. The scanned lens is designed to electronically scan over a $\pm\theta_s$ conical volume about its normal. The scanned lens is mechanically positionable by a device 104 and a connector 105 about the antenna center line over a $\pm\theta_T$ range in any plane. Thus, the combined mechanical and electronic scan provides coverage over a $\pm(\theta_s+\theta_T)$ conical volume, with a fast electronic scan capability over a $\pm\theta_s$ cone. This is shown in FIG. 1.

For example, to scan to 50°, the scanned lens is tilted 25°, and electronically scanned 25°. Thus, at this maximum scan, the lens both receives and transmits at 25° from its normal, which represents the maximum incidence and exit angles on the two faces. Thus, the lens need be designed for only 25° scan, resulting in a requirement for fewer phase shifters than a stationary scanned lens.

The collimating lens 102 illuminates the scanned lens 100 with parallel rays, which makes it possible to achieve this lesser number of phasers. If a point source feed were to be used, its diverging rays would increase the incidence angles on the feed side and require a closer packed grid of phase shifters.

If the scanned lens is made equal in diameter to the collimating lens, the energy G captured by the scanned lens is decreased by a factor of $\cos\theta_T$. The effective aperture of the scanned lens in the direction of radiation is decreased by $\cos\theta_s$. Thus, the scan loss of this antenna varies with scan as $$G=G_0\cos\theta_T\cos\theta_s.$$

Where $G_0$ is maximum energy available from lens 102.

For the case of 50° scan, $\theta_s=\theta_T=25°$, the resulting scan loss is −0.85 dB. The beamwidth of the beam in the scanned plane is increased by $1/\cos\theta_s$, which for $\theta_s=25°$ results in only 10% beam broadening over the entire scan volume. Thus, the gain loss and beam broadening effect are less in this antenna than for an all electronically scanned array, where the scan loss is −1.9 dB and the beam is broadened by 56%.

The $\cos\theta_T$ factor due to the scanned lens not capturing all the incident energy when rotated, could be avoided by increasing its diameter by 10%; however, this would require more space and more phase shifters.

If linear polarization is used throughout the antenna, then the movable lens must be tilted without rotating about its axis. This type of motion can be obtained by use of linear actuators 106A and 106B to tilt the movable lens (shown in FIG. 2). If it is desired or required to use a rotating mount, such as an elevation-over-azimuth mechanism, so that the movable lens rotates about its axis, this can be accommodated by one of several ways:

1. Use polarization insensitive phase shifters in the scanned lens.

2. Illuminate the movable lens from the feed and collimating lens with circular polarization, and employ a circular-to-linear conversion at the feed side of the scanned lens. This may be done in each element individually or with a quarter-wave panel attached to the surface of the scanned lens on its feed side.

Advantages of this concept are:

1. Coverage of a hemisphere (or somewhat greater) is achieved with a single antenna, with fast electronic scan provided over a limited sector.

2. The number of phase shifters are minimized for a given limited electronic scan region. This occurs because of limited electronic scan and because plane wave illumination of the scanned lens is used.

3. Beam broadening with scan is less than with an all electronic scan antenna.

I claim:

1. A system comprising a movable electronic scanned lens; a source of electromagnetic energy located spatially from said lens; said source of electromagnetic energy spatially feeding said energy to said lens; a collimation lens located between said source of electromagnetic energy and said scanned lens so as to collimate the electromagnetic energy to said scanned lens; said scanned lens reradiating said energy to a predetermined portion of space by a combination of electronic scanning and mechanical movement of said scanned lens; said movable scanned lens being made of an array of phase shifter modules with antenna elements on both ends of each module; said collimating lens illuminating the scanned lens with parallel electromagnetic energy rays; and a feedhorn directing said electromagnetic energy onto said collimating lens.

* * * * *